US005961278A

United States Patent [19]

Dorais et al.

[11] Patent Number: 5,961,278

[45] Date of Patent: Oct. 5, 1999

[54] HOUSING FOR TURBINE ASSEMBLY

[75] Inventors: Francois Dorais, St. Jean sur Richelieu; Guy Bouchard, Mont St. Hilaire, both of Canada

[73] Assignee: Pratt & Whitney Canada Inc., Longueuil, Canada

[21] Appl. No.: 08/992,673

[22] Filed: Dec. 17, 1997

[51] Int. Cl.[6] ..... F01D 25/26; F03B 1/00

[52] U.S. Cl. ..... 415/137; 415/209.2; 415/209.4

[58] Field of Search ..... 415/136, 137, 415/189, 190, 209.2, 209.3, 209.4, 210.1

[56] References Cited

U.S. PATENT DOCUMENTS

| | | | |
|---|---|---|---|
| 3,423,071 | 1/1969 | Noren | 415/189 |
| 3,825,364 | 7/1974 | Halila et al. . | |
| 3,834,001 | 9/1974 | Carroll et al. . | |
| 3,966,353 | 6/1976 | Booher, Jr. et al. | 415/190 X |
| 3,986,789 | 10/1976 | Pask . | |
| 4,155,680 | 5/1979 | Linko, III et al. | 415/144 |
| 4,643,636 | 2/1987 | Libertini et al. | 415/138 |
| 4,798,514 | 1/1989 | Pask . | |
| 4,889,469 | 12/1989 | Wilkinson | 415/137 X |
| 5,288,206 | 2/1994 | Bromann et al. | 415/209.2 |
| 5,299,910 | 4/1994 | Gilchrist | 415/209.3 |
| 5,520,508 | 5/1996 | Khalid . | |

*Primary Examiner*—John R. Ryzinic
*Attorney, Agent, or Firm*—Jeffrey W. Astle

[57] ABSTRACT

An outer housing for supporting a stator assembly in a gas turbine engine, wherein the support includes two outer ring sections between which the vane segments of the stator assembly are mounted to form a ring within the cylindrical support. A central ring section is provided between the outer ring sections and is connected thereto by means of spokes. The central ring section locates the structure within the engine casing. The spokes extend at an angle to the axis of the stator assembly and define openings therebetween whereby thermal distortion between the outer rings and the central ring is attenuated.

13 Claims, 2 Drawing Sheets

HOUSING FOR TURBINE ASSEMBLY

BACKGROUND OF THE INVENTION

1. Field of the Invention

This invention is directed toward a support structure for stator vane segments used in a gas turbine engine. The invention is also directed toward an improved stator assembly in a gas turbine engine, which assembly incorporates the support structure. The invention is more particularly directed toward an improved stator assembly in a gas turbine engine that is fixed at its outer radial end and which assembly incorporates the support structure.

2. Description of the Prior Art

Second stator assemblies in gas turbine engines usually have the inner radial end of the assembly floating on a seal arrangement on the rotating shaft of the turbine. The outer radial end of the assembly must be fixed to the outer engine casing. This is usually done by a ring-like support structure. However, in fixing the outer end of the second stator assembly to the outer engine casing, thermal expansion of the stator vane segments can cause distortion of the support structure which in turn can cause distortion in the outer engine casing. Distortion of the outer engine casing can change blade tip clearances for the blades in adjacent rotor assemblies in the engine which can reduce the efficiency of the engine.

The distortion could be reduced by adequate cooling of the stator vane segments. However, it is difficult to efficiently cool the vane segments when they are fixedly mounted at their outer ends.

SUMMARY OF THE INVENTION

It is a purpose of the present invention to provide a support structure for use in mounting the outer end of the stator assembly to the outer engine casing, which support structure minimizes distortion of the outer engine casing due to thermal expansion of the stator vane segments.

It is another purpose of the present invention to provide a support structure which provides for more efficient cooling of the stator vane segments, especially the outer vane platform.

In accordance with the present invention, the improved support structure is constructed in the form of a lightweight cylinder within which the vane segments are mounted to form a ring. The cylinder is constructed with two outer rings, between which the vane segments are mounted, and with a central ring used to radially locate the cylinder relative to the outer engine casing. The rings are joined to form the cylindrical shaped structure by thin, circumferentially spaced-apart spokes extending between each outer ring and the central ring. The spokes are thin enough to flex or distort when the stator vane segments thermally expand, expanding or distorting the outer mounting rings, to attenuate the distortion transmitted from the outer mounting rings to the central ring and thus to the engine casing. Thus, less distortion is transmitted to the casing and better control of the rotor blade tip clearance is maintained. Using thin spokes to connect the rings of the support structure together permits large openings in the cylindrical structure to allow the impingement flow of cooling air to the outer platforms of the vane segments, thus further reducing distortion.

The invention is particularly directed toward a generally cylindrical support structure for use in a stator assembly in a gas turbine engine having an engine casing. The support structure has two outer ring sections between which vane segments of the stator assembly will be mounted and a central ring section by means of which the support structure will be radially located within the engine casing. Connecting means extend between the outer ring sections and the central ring section, the connecting means constructed to attenuate thermal distortion transmitted between the outer ring sections and the central ring section.

The invention is also directed toward a stator assembly in a gas turbine engine having an engine casing, the assembly comprising a plurality of stator vane segments abutting to form a stator ring and a generally cylindrical support structure within which the vane segments are assembled to form the stator ring. The support structure has two outer ring sections between which the vane segments are mounted and a central ring section by means of which the support structure is radially located within the engine casing. Connecting means extend between the outer ring sections and the central ring sections, the connecting means constructed to attenuate thermal distortion transmitted between the outer ring sections and the central ring section.

BRIEF DESCRIPTION OF THE DRAWINGS

Having thus generally described the nature of the invention, reference will now be made to the accompanying drawings, showing by way of illustration, a preferred embodiment thereof, and in which.

DESCRIPTION OF THE PREFERRED EMBODIMENTS

Figure 1:
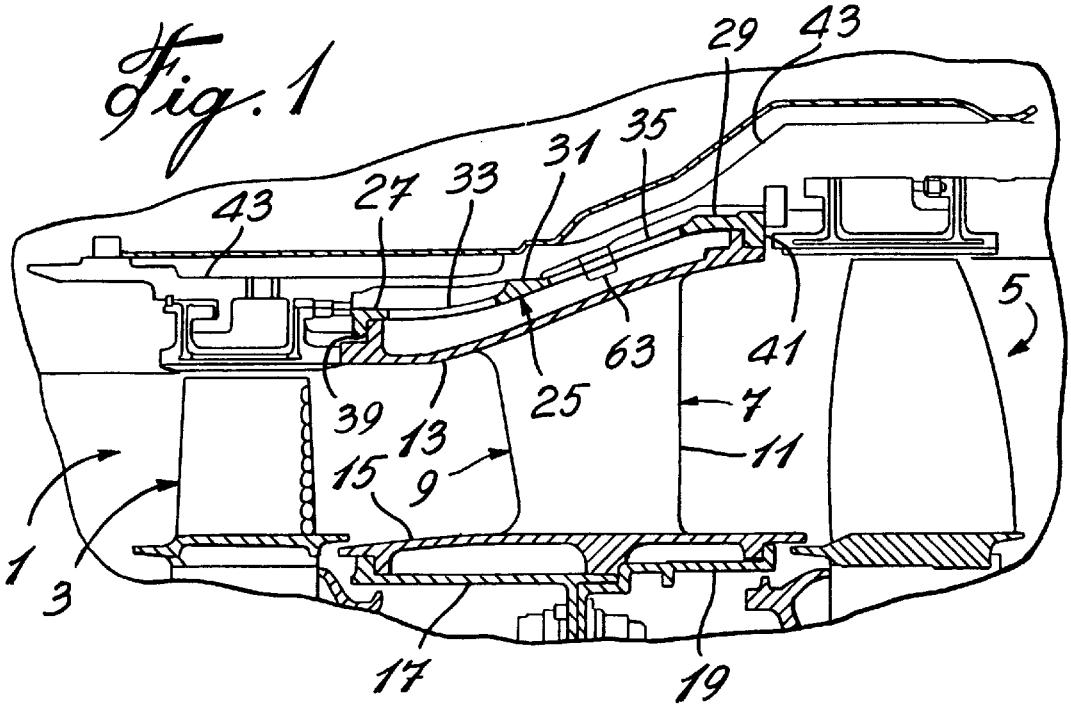
FIG. 1 is a partial cross-sectional view through the stator of a gas turbine engine.

The gas turbine engine 1, as shown in FIG. 1, has axially spaced-apart rotor stages 3, 5 between which is mounted a stator stage 7. The stator stage 7 comprises a plurality of stator vane segments 9 that are mounted in abutting relationship to form a circular ring. Each vane segment 9 has one or more stator vanes 11 extending between an outer vane platform 13 and an inner vane platform 15. The side edges of the outer vane platforms 13 abut as do the side edges of the inner vane platforms 15 when forming the ring. The inner vane platforms 15 are mounted between inner engine housings 17, 19 to locate them axially and radially.

Figure 2:
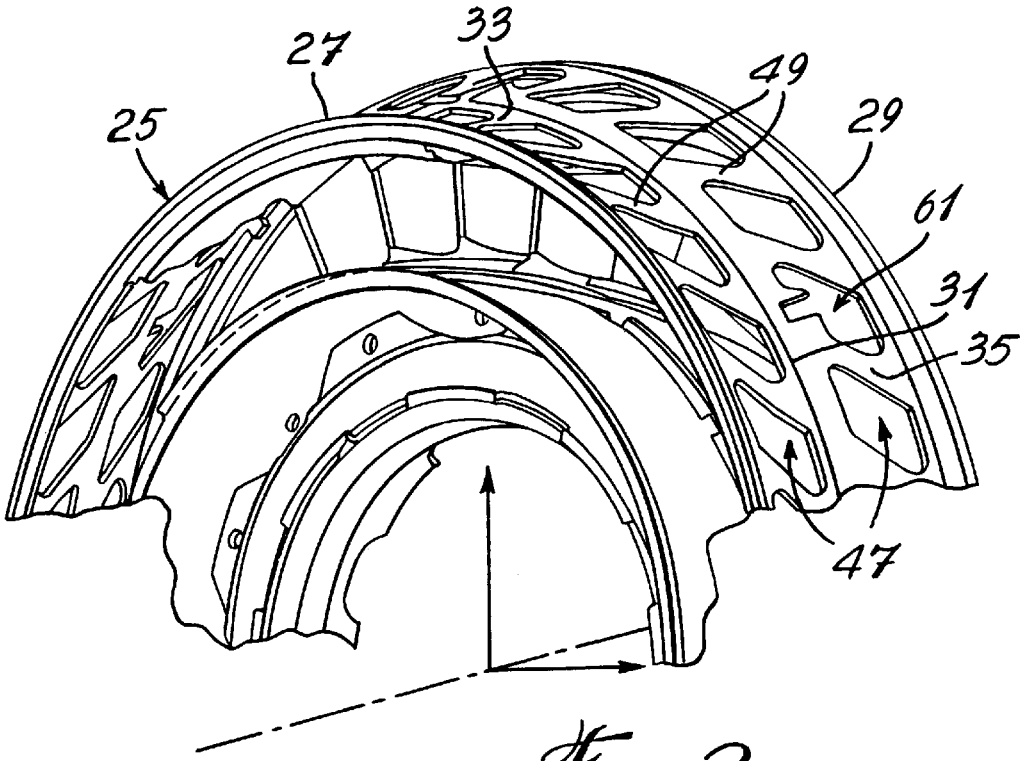
FIG. 2 is a partial perspective view of the support structure of the present invention.

A generally cylindrical support structure 25 is provided, as shown in FIGS. 1 and 2, within which the ring of vane segments 9 are mounted. The cylindrical support structure 25 has three axially spaced-apart ring sections 27, 29, 31. The ring sections 27, 29, 31 are relatively thick in the radial direction. Relatively thin cylindrical webs or spokes 33, 35 join the outer ring sections 27, 29 to the central ring section 31.

The outer ring sections 27, 29 of the support structure each have an inwardly directed radial flange 39, 41 between which the outer vane platforms 13 of the vane segments 9 are mounted to axially and radially locate them. The central ring section 31 of the support structure 25 bears against the outer engine casing 43 of the turbine engine to radially locate the support structure relative to the casing.

The vane segments 9 can cause a radial thermal mismatch in expansion of the support structure 25 when the vane segments 9 thermally expand. In accordance with the present invention, the support structure 25 is constructed to attenuate any thermal distortions transmitted through the support structure between the outer ring sections 27, 29 and the central ring section 31 from thermal expansion of the vane segments 9. More particularly, the webs or spokes 33, 35 are constructed to attenuate the thermal distortions. The spokes 33, 35 attenuate the thermal distortions by having large cutouts 47 therein, arranged circumferentially to define thin, narrow spokes 49 between the ring sections 27, 31 and the ring sections 29, 31. The number, size and location, and the shape of the cutouts 47 is such as to have the webs 33, 35 provide maximum attenuation of the thermal distortion of the support structure 25. The cutouts 47 are also shaped to maximize cooling air flow clearance and to impinge cooling air directly on the outer vane platforms 13 of the vane segments 9 from the engine casing 43 with minimum pressure drop. The cutouts 47 are preferably shaped to provide angled spokes 49, angled relative to the longitudinal axis of the support structure, so as to minimize turbulence in the flow of the cooling air.

The support structure 25 can be made in one piece or it can be made from cylindrical segments joined together by suitable means. The support structure 25 is light in weight. The support structure 25 also ensures good axial and radial sealing with the engine casing 43 relative to fluid flow through the stator and across the face of the stator. The clearance between the stator vane segments 9, at room temperature, is set such that at steady state engine operating conditions, sealing between the segments 9, the inner engine housings 17, 19 and the segments 9, and the support structure 25 and the segments 9 is accomplished and maintained.

Figure 3:
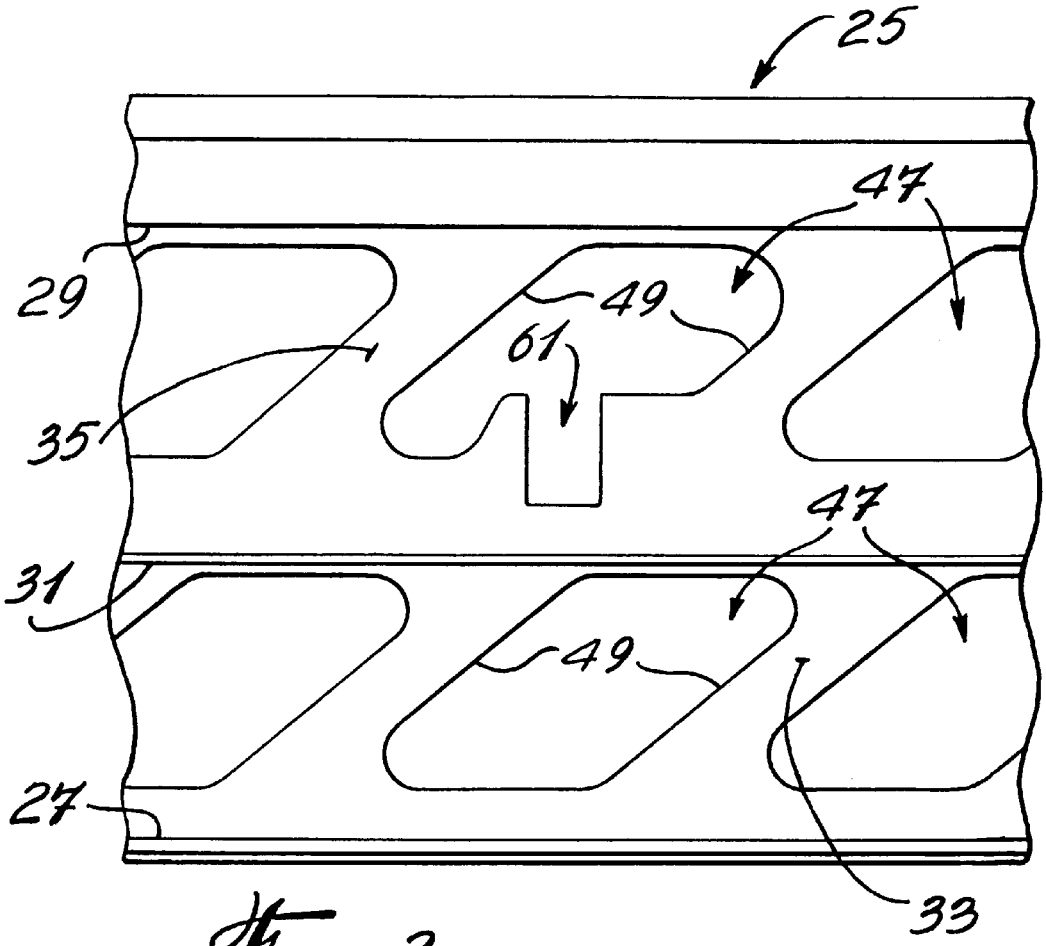
FIG. 3 is a detail plan view of a section of the support structure.
Figure 4:
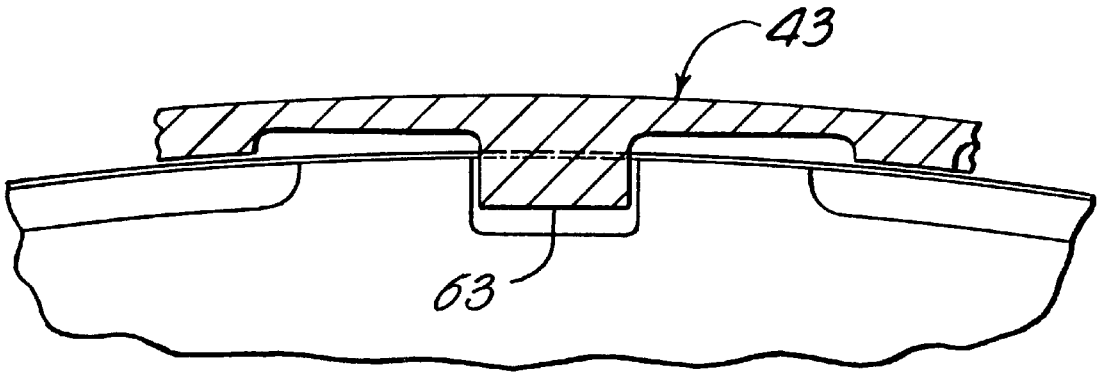
FIG. 4 is a detail cross-sectional view of the support structure and outer casing.

Locking means can be provided to prevent rotation of the support structure 25 relative to the outer engine casing 43. The locking means can comprise a number of slots 61, as shown in FIGS. 2 and 3, formed in one of the webs 33, 35, the slots 61 circumferentially spaced apart. Tabs 63 are provided on the inner surface of the outer engine casing 43, one tab 63 for each slot 61. The tabs 63 fit in the slots 61, as shown in FIG. 4, to prevent rotation of the support structure 25 relative to the casing 43.

We claim:

1. A cylindrical support structure for use in a stator assembly in a gas turbine engine having an engine casing, the support structure having: two outer ring sections between which vane segments of the stator assembly will be mounted to form a ring within the support structure; a central ring section by means of which the support structure will be radially located within the engine casing; and connecting means extending between the outer ring sections and the central ring section, the connecting means constructed to attenuate thermal distortion transmitted between the outer ring sections and the central ring section.

2. A support structure as claimed in claim 1, wherein the connecting means comprise narrow, thin spokes joining the ring sections together.

3. A support structure as claimed in claim 2, wherein the spokes are angled relative to the axis of the support structure.

4. A support structure as claimed in claim 1, wherein the connecting means comprise webs extending between the ring sections, and cutouts in each web spaced apart circumferentially, the cutouts defining narrow, thin spokes between them.

5. A support structure as claimed in claim 4, wherein the spokes are angled relative to the axis of the support structure.

6. A stator assembly in a gas turbine engine having an engine casing, the assembly comprising a plurality of stator vane segments abutting to form a stator ring and a generally cylindrical support structure within which the vane segments are assembled to form the stator ring; the support structure having two outer ring sections between which the vane segments are mounted and a central ring section by means of which the support structure is radially located within the engine casing; and connecting means extending between the outer ring sections and the central ring sections, the connecting means constructed to attenuate thermal distortion transmitted between the outer ring sections and the central ring section.

7. A stator assembly as claimed in claim 6, wherein the connecting means comprise narrow, thin spokes joining the ring sections together.

8. A stator assembly as claimed in claim 7, wherein the spokes are angled relative to the axis of the support structure.

9. A stator assembly as claimed in claim 6, wherein the connecting means comprise webs extending between the ring sections, and cutouts in each web spaced apart circumferentially, the cutouts defining narrow, thin spokes between them.

10. A stator assembly as claimed in claim 9, wherein the spokes are angled relative to the axis of the support structure.

11. A stator assembly as claimed in claim 9, including cooperating locking means on the support structure and the engine casing for preventing rotation of the support structure relative to the casing.

12. A stator assembly as claimed in claim 11, wherein the locking means comprises a set of circumferentially spaced-apart slots formed in at least one of the webs and cooperating tabs on the engine casing, the tabs extending radially inwardly and sized and located to have each one fit in a slot in the support structure.

13. A stator assembly as claimed in claim 6, including cooperating locking means on the support structure and the engine casing for preventing rotation of the support structure relative to the casing.

* * * * *